US006655450B2

(12) United States Patent
Nishio et al.

(10) Patent No.: US 6,655,450 B2
(45) Date of Patent: Dec. 2, 2003

(54) FORCED OSCILLATORY FLOW TYPE HEAT PIPE AND DESIGNING METHOD FOR THE SAME

(75) Inventors: Shigefumi Nishio, Tokyo (JP); Hisashi Tanaka, Tokyo (JP); Kouji Kubo, Komae (JP)

(73) Assignee: TS Heatronics Co., Ltd., Kanagawa (JP)

( * ) Notice: Subject to any disclaimer, the term of this patent is extended or adjusted under 35 U.S.C. 154(b) by 0 days.

(21) Appl. No.: 10/160,969

(22) Filed: May 31, 2002

(65) Prior Publication Data

US 2002/0189792 A1 Dec. 19, 2002

(30) Foreign Application Priority Data

Jun. 7, 2001 (JP) ..... 2001-172566

(51) Int. Cl.[7] ..... F28D 15/00

(52) U.S. Cl. ..... 165/104.21; 165/109.1; 165/86; 165/104.23

(58) Field of Search ..... 165/84, 86, 109.1, 165/104.21, 104.23, 104.25, 104.33

(56) References Cited

U.S. PATENT DOCUMENTS 3,729,138 A * 4/1973 Tysk ..... 239/102
4,350,838 A * 9/1982 Harrold ..... 165/104.33
4,406,323 A * 9/1983 Edelman ..... 165/84
4,501,319 A * 2/1985 Edelman et al. ..... 165/84
4,967,829 A * 11/1990 Albers et al. ..... 165/109.1
5,297,734 A * 3/1994 Toda ..... 239/102.2
5,518,179 A * 5/1996 Humberstone et al. .. 239/102.2
6,059,020 A * 5/2000 Jairazbhoy et al. ..... 165/84
6,247,525 B1 * 6/2001 Smith et al. ..... 165/104.25

OTHER PUBLICATIONS

Althouse et al., Modern Refrigeration & Air Conditioning,.*
Shigefumi Nishio et al; "Oscillation–induced Heat Transport: Heat Transport Characteristics Along Liquid–columns of Oscillation–controlled Heat Transport Tubes"; (1995); Int. J. Heat Mass Transfer, vol. 38, No. 13, pp. 2457–2470.
Shigefumi Nishio et al' Study on Oscillation–Controlled Heat Transport Tube (3rd Report, Inverted Oscillation–Phase Heat Transport Tube); (1994) Transaction Of The Japan Society Of Mechanical Engineers B Edition. No. 94–0369; pp. 276–281.
U. H. Kurzweg and Ling De Zhao, "Heat Transfer By High–Frequency Oscillations: A New Hydrodynamic Technique For Achieving Large Effective Thermal Conductivities" Phys. Fluids 27 (11), Nov., 1984, pp.2624–2627.

* cited by examiner

*Primary Examiner*—Terrell McKinnon
(74) *Attorney, Agent, or Firm*—Frishauf, Holtz, Goodman & Chick, P.C.

(57) ABSTRACT

A forced oscillatory flow type heat pipe of which a ratio (motion coefficient) of the heat transport capacity to the oscillating energy is maintained within an appropriate range is provided. A heat pipe body (1) has a closed loop flow path (2). Operation of the vibrator (3), which is provided at a connecting portion (2*a*) between the ends of the flow path (2), causes an oscillatory flow of the charged liquid sealed in the flow path (2). The phases of the oscillatory flows of the charged liquid in the adjacent tube portions of the flow path are inverted. From a viewpoint that the dimensionless effective thermal diffusivity kef* of the COSMOS type heat pipe has a larger range in the modified Womersley number $\alpha$ than that of the dream type heat pipe, the modified Womersley number $\alpha$ is 0.4 to 7.

6 Claims, 5 Drawing Sheets

(a) COSMOS-HP (b) Dream pipe

FIG. 5

| | Na-K | Water | Ethanol |
|---|---|---|---|
| $2H$[mm] | 5.4 | 0.48 | 0.37 |
| $\chi$ | 34 | 40 | 40 |
| $\eta_{se}$ | 130 | 8.9 | 2.0 |

FORCED OSCILLATORY FLOW TYPE HEAT PIPE AND DESIGNING METHOD FOR THE SAME

FIELD OF THE INVENTION

The present invention relates to a forced oscillatory flow type heat pipe for transferring heat generated from a heating element such as a semiconductor element by an oscillatory flow of a charged liquid. Particularly, it relates to a forced oscillatory flow type heat pipe in which a ratio (motion coefficient) of the heat transport capacity to the oscillating energy is maintained within an appropriate range. And, it relates to a designing method for such a heat pipe.

BACKGROUND OF THE INVENTION

A heat pipe is a device capable of transferring a large amount of heat by circulating a charged and sealed liquid in the pipe. Such a heat pipe has been used for cooling a heating element, such as a semiconductor element mounted on an electronic circuit board.

Recently, the integration of electronic components mounted on a circuit board has been increasingly high. Accordingly, miniaturization and improvement in heat transport capacity for a heat pipe has been requested. For example, in a notebook-type personal computer, a heat pipe requires further reduction in the diameter and the thickness thereof for assembling in the housing of the computer. In addition, to transfer heat to the backside of the liquid crystal panel, the heat pipe requires more flexibility.

A typical type of heat pipe is a wick type heat pipe, in which evaporation and condensation of a charged liquid occurs, and circulation of the condensed liquid to a heat absorbing section (evaporating section) is carried out by the capillary action of a wick or the like.

Here, the above-mentioned wick type heat pipe has the following shortcomings.

(a) There exists an upper limit in the heat transport capacity. The upper limit lowers rapidly when the pipe diameter becomes smaller.

(b) The heat pipe has a complicated and specialized inside structure for circulating the charged liquid.

(c) The heat transport capacity is easily affected by non-condensational gas concentration in the liquid.

(d) Since the wick type heat pipe is a passive device (a device which drives without external power), it is difficult to drive under a top heat condition (a condition in which the heat absorbing section is positioned at the upper position along the gravity direction) or a small gravity field condition.

Due to those shortcomings of the above-mentioned (a) or (b), it is difficult to reduce the diameter of the wick type heat pipes and also difficult to give more flexibility to them. Accordingly, a new type of heat pipe free from the above shortcomings (a) to (d) is needed.

Under such technical background, an oscillatory flow type heat pipe which effectively transfers heat by an oscillatory flow of the charged liquid is now drawing the attention of the industry. The oscillatory flow type heat pipe is classified into two types, (I) and (II) as mentioned below.

(I) A type in which a phase change in the charged liquid is utilized.

This type of heat pipe has a meandering closed loop tunnel filled with a working liquid and vapor thereof with a certain proportion, and utilizes a self-generated two-phase oscillatory flow and a pulsing flow.

(II) A type in which a phase change of the charged liquid is not utilized.

The heat pipe of this type, in which the diffusion enhancing effect in a forced oscillatory flow is utilized, is called as a forced oscillatory flow type heat pipe. The forced oscillatory flow type heat pipe is further classified into two types; a synchronized phase type (so-called a dream pipe) and an inverted phase type (COSMOS (Counter- Stream- Mode-Oscillating- Flow) type).

In the dream type heat pipe, the heat pipe body is constructed of a capillary bundle, and phases of oscillatory flows of the charged liquid in the adjacent capillaries are synchronized. Such a dream type heat pipe is proposed by Kurzweg-Zhao, Phys. Fluid, 27 (1984), 2624–2627.

In the COSMOS type heat pipe, the heat pipe body is constructed of a meandering closed loop flow path, and phases of the oscillatory flows of the charged liquid in the adjacent passages of the meandering flow path are inverted. The COSMOS type heat pipe has a higher response to the top heat condition than a wick type heat pipe or the phase change type heat pipe does. Furthermore, since the heat transport capacity of the COSMOS type heat pipe can be controlled by changing the amplitude and the frequency of the oscillatory flow, it has an advantage that a temperature of a heat radiating body can be also controlled. Moreover, the heat pipe may have a smaller diameter and higher flexibility.

However, the COSMOC type heat pipe capable of practical use is not developed.

The object of the present invention is therefore to provide a forced oscillatory flow type heat pipe in which a ratio (motion coefficient) of the heat transport capacity to the oscillating energy is selected in an appropriate range. And, it is also to provide a designing method for such a heat pipe.

SUMMARY OF THE INVENTION

In order to solve the above-mentioned problems, a forced oscillatory flow type heat pipe according to the present invention has a heat pipe body with a closed loop flow path which meanders between a heat absorbing section and a heat radiating section, a liquid charged in said flow path and a mechanism causing an oscillatory flow of said charged liquid, wherein phases of said oscillatory flows of said charged liquid in the adjacent passages of said meandering flow path being inverted, wherein said charged liquid has Prandtle number Pr of less than 100 and modified Womersley number $\alpha$ of 0.4 to 7, and the Womersly number being defined as $$\alpha = H(\omega/\kappa)^{1/2}$$

where H(m) is half of a width of said flow path; $\omega$(1/s) is angle frequency of oscillation; and $\kappa$($m^2$/s) is heat diffusion coefficient of the charged liquid.

A method for designing a forced oscillatory flow type heat pipe according to the present invention is for designing a forced oscillatory flow type heat pipe which has a heat pipe body with a closed loop flow path which meanders between a heat absorbing section and a heat radiating section, a liquid charged in said flow path and a mechanism causing a oscillatory flow of said charged liquid, wherein phases of said oscillatory flows of said charged liquid in the adjacent passages of said meandering flow path being inverted, wherein said charged liquid has Prandtle number Pr of less than 100 and modified Womersley number $\alpha$ of 0.4 to 7, and the Womersly number being defined as $$\alpha = H(\omega/\kappa)^{1/2},$$

where H(m) is half of a width of said flow path; ω(1/s) is angle frequency of oscillation; and κ($m^2$/s) is heat diffusion coefficient of the charged liquid.

According to the present invention, a means in which a ratio (motion coefficient) of the heat transport capacity to the oscillating energy is maintained within an appropriate range is provided to promote practical application and generalization for the forced oscillatory flow type heat pipe.

Also, it is preferable that the forced oscillatory flow type heat pipe according to the present invention has said Prandtle number Pr of less than 50 and said modified Womersely number α of 0.4 to 7. Also, it is preferable that specific heat of said charged liquid is higher than 100 j/kg.K.

BRIEF DESCRIPTION OF THE DRAWINGS

FIG. 4 (A) is a graph in the case of the COSMOS type heat pipe, and FIG. 4 (B) is a graph in the case of the dream type heat pipe.

FIG. 5 is a table showing a relation of a width 2H of the flow path, the ratio x of the obtained effective thermal diffusivity to the thermal diffusivity of copper and the value of the reference motion coefficient $\eta^{se}$.

DETAILED DESCRIPTION OF EMBODIMENT OF THE INVENTION

The preferred embodiments of the present invention will be described in detail with reference to the accompanying drawings.

Firstly, a structure of an inversed phase (COSMOS type) forced oscillatory flow type heat pipe (hereinafter, it is called as a COSMOS heat pipe) will be explained.

Figure 1:
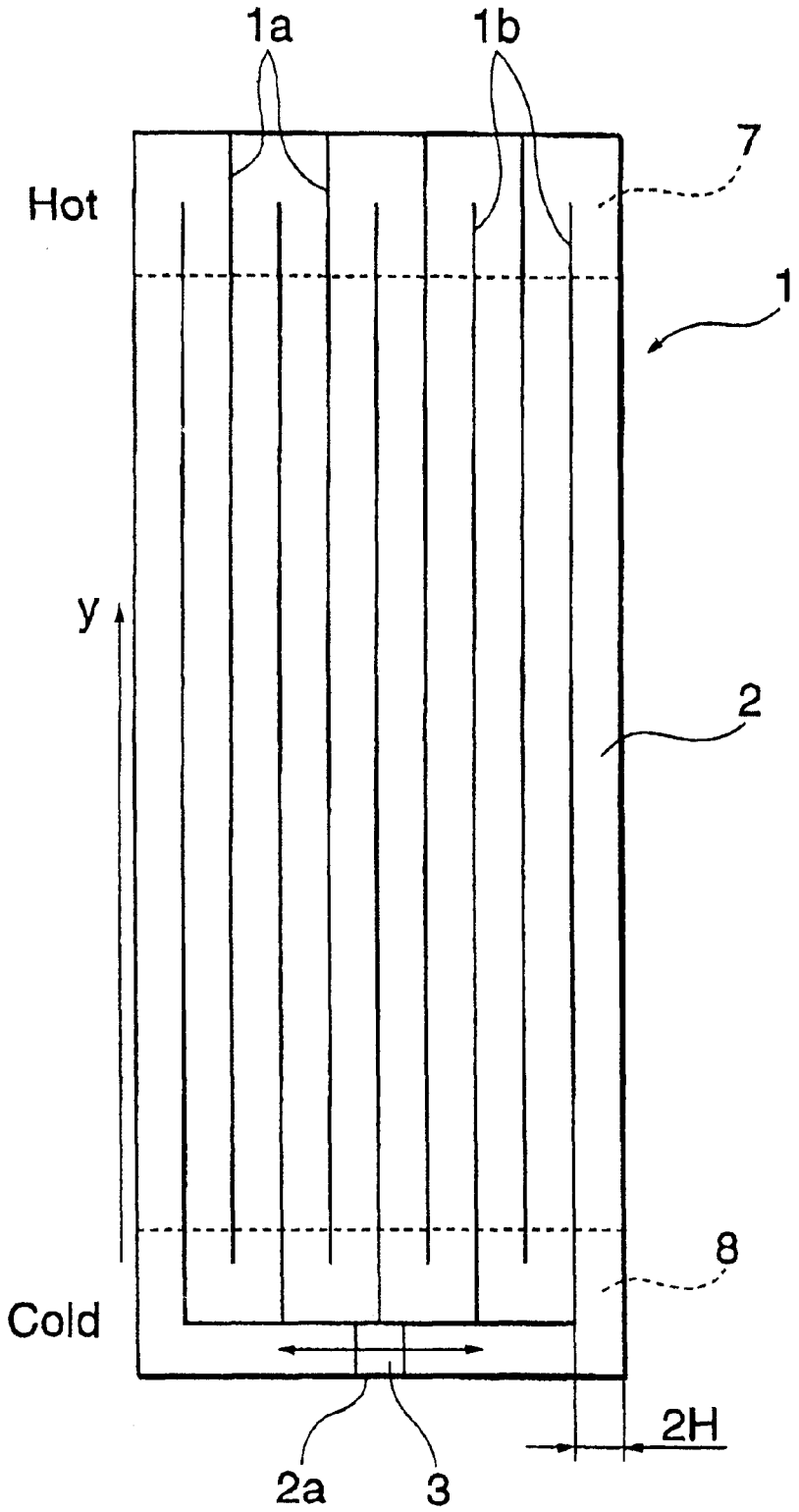
FIG. 1 is a drawing schematically showing one example of the COSMOS heat pipe according to the present invention.

FIG. 1 is a drawing schematically showing one example of the COSMOS heat pipe according to the present invention.

As shown in FIG. 1, a heat pipe body 1 of the COSMOS heat pipe has a closed loop flow path 2 which meanders between a heat absorbing section and a heat radiating section. The meandering flow path 2 of the heat pipe body 1 consists of tube portions (passages) divided by walls 1*a* (there are 4 walls in the FIG. 1), extending from the upper to lower in the figure, and walls 1*b* (there are 5 walls in the FIG. 5), extending from the lower to upper in the figure.

In the flow path 2 of the heat pipe body 1, a liquid is charged and sealed off from the outside. For such a system, various types of liquid may be used as mentioned below. At a connecting portion 2*a* between both ends of the flow path 2 of the heat pipe 1, a vibrator (a mechanism causing an oscillatory flow of the charged liquid) 3 is provided. For the vibrator, a solenoid or a diaphragm may be used. Operation of the vibrator 3 will cause an oscillatory flow of the charged liquid sealed in the flow path 2. The phases of the oscillatory flows of the charged liquid are inverted in the adjacent tube portions of the meandering flow path.

Here, in such the COSMOS type heat pipe, one end of the tube portions of the meandered flow path to the longitudinal direction, that is the upper in the figure, is the heat absorbing portion 7, and the other end thereof, the lower in the figure, is the heat radiating portion 8.

Next, as a reference example, a structure of a synchronized phase forced oscillatory flow type heat pipe (dream type) will be explained.

Figure 2:
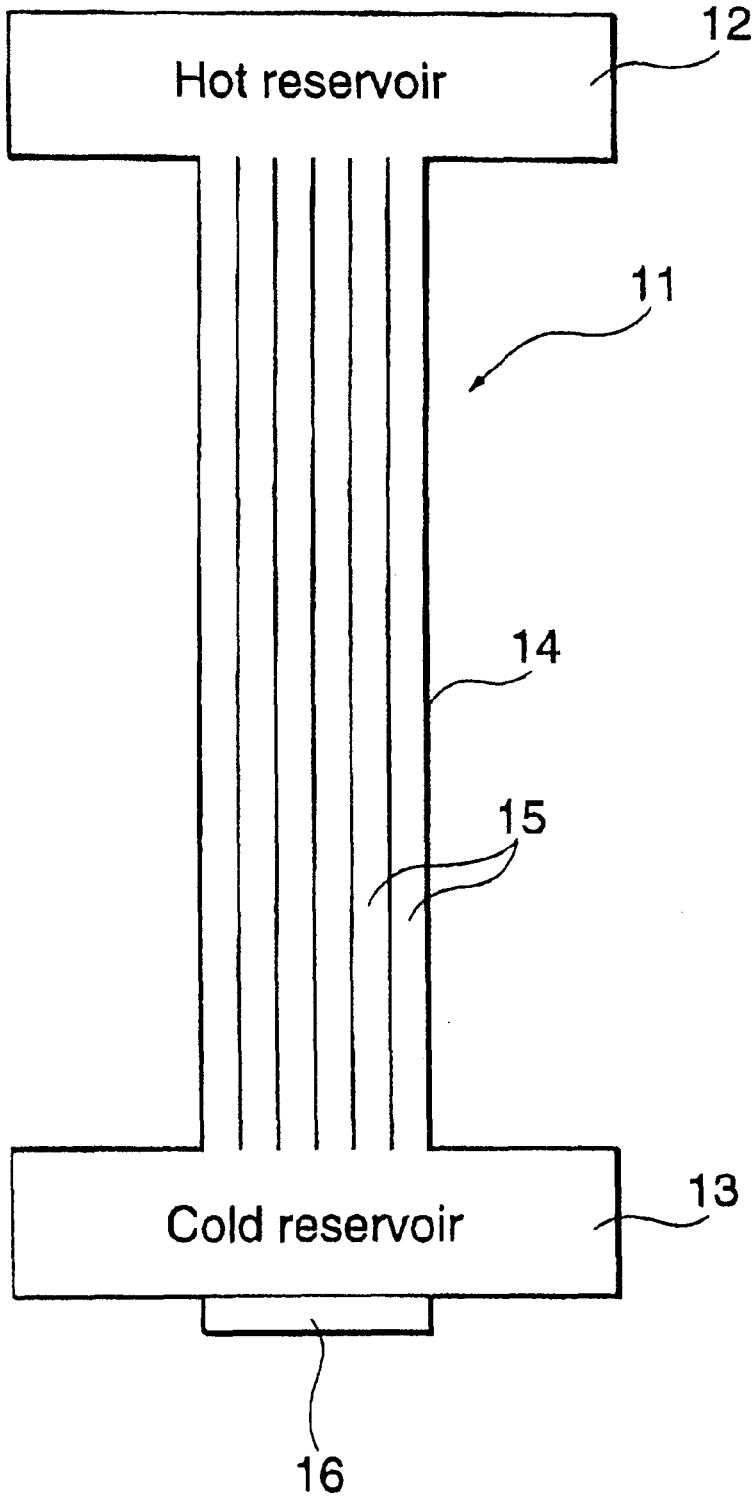
FIG. 2 is a drawing schematically showing one example of a synchronized phase forced oscillating flow type heat pipe (dream type).

FIG. 2 is a drawing schematically showing one example of a synchronized phase forced oscillating flow type heat pipe (dream type).

The heat pipe body 11 of the dream type heat pipe, as shown in FIG. 2, is provided with a hot reservoir 12 and a cold reservoir 13. Between the reservoirs 12, 13, a capillary bundle 14 is connected. The capillary bundle 14 in this example consists of five small capillaries, each of which is divided by a capillary wall 14*a*. In the both reservoirs 12, 13 and a flow path 15 of the capillary bundle 14, a charged liquid is sealed. At the cold reservoir 13 of the heat pipe body 11, a vibrator (a mechanism causing an oscillatory flow of the charged liquid) 16, such as solenoid or a diaphragm, is provided. Operation of the vibrator 16 will cause an oscillatory flow of the charged liquid sealed in the heat pipe body 11. The phases of the oscillatory flows of the charged liquid are synchronized in the adjacent capillaries 15.

Next, regarding the COSMOS type heat pipe, a designing condition to maintain a ratio (motion coefficient) of the heat transport capacity to the oscillating energy within the appropriate range will be explained.

As the COSMOS type heat pipe as shown in FIG. 1, a laminar oscillatory flow having a regular frequency is examined, which is induced, in a two-dimensional flow path having a width of 2H between the parallel plates, under the condition of a pressure gradient in the longitudinal direction y of the flow path: Pcos (ωt)(P(Pa) shows a pressure amplitude of the oscillatory flow), angle frequency of the oscillation of the vibrator: w(1/s) and time: t(s). Here, the following expression supposes that the thickness of the wall of the flow path is zero for simplicity. Such the supposition makes little difference as long as a standard material such as a copper or aluminum having a standard thickness (for example, 0.1 to 0.3 mm) is selected.

As one of the inventor of the present invention and the others disclosed in "Transaction of the Japan Society of Mechanical Engineers B Edition," 60(1994), 3498–3503, Xiao-Hong SHI, Shigefumi NISHIO and Kohji FUNATSU, and "Int. J. Heat&Mass Transfer", 38(1995), 2457–2470, S Nishio, X. -H. Shi and W. -M. Zhang, the following equation 1 is established for the non-dimension effective thermal diffusivity kef* in the COSMOS type heat pipe.

$$\kappa_{ef}^*[Pr,\alpha] \equiv M_\kappa[Pr,\alpha] \equiv \frac{\kappa_{ef}}{\omega S^2} = \frac{\mathrm{Re}\left[\frac{\sqrt{i}}{Pr^2-1}\left(Pr\tanh\left[\sqrt{i}\,\frac{\alpha}{\sqrt{Pr}}\right]-\frac{\tanh[\sqrt{i}\,\alpha]}{\sqrt{Pr}}\right)\right]}{2(M_u-1)\frac{\alpha}{\sqrt{Pr}}}; \quad \text{Equation 1}$$

where '≡' denotes 'defining'.

In equation 1, i shows imaginary unit, Re [X] shows real part of X. And, Pr shows Prandtle number, α shows modified Womersley number. Here, the modified Womersley number α is defined by the following equation.

$$\alpha = H(\omega/\kappa)^{1/2}$$

where H(m) is half of a width of the flow path of the pipe (as shown in FIG. 1); ω(1/s) is angle frequency of the oscillation of the vibrator (as shown in FIG. 1) and κ($m^2$/s) is the thermal diffusivity of the charged liquid.

And, Mu in equation 1 is given in the following equation 2.

$$M_u = \frac{2\{\beta\sinh[\beta] + \beta\sin[\beta] - \cosh[\beta] + \cos[\beta]\}}{\beta^2\{\cosh[\beta] + \cos[\beta]\}}; \qquad \text{Equation 2}$$

where β≡H√(2ω/v) and v($m^2$/s) is coefficient of kinematic viscosity.

And, in equation 1, $\kappa_{ef}$($m^2$/s) is the effective thermal diffusivity of the charged liquid and S(m) is the volume amplitude of the oscillatory flow.

On the other hand, when the dream type heat pipe, as shown in FIG. 2, has a unit length and a unit temperature gradient (temperature gradient Ω=1(K/m)), the reference motion coefficient $\eta_{se}$ defined as a ratio of transferable heat amount (W) by the dream type heat pipe to a work for driving an oscillatory flow is given as equation 3.

$$\eta_{se} = \frac{k_{ef}A_c}{\frac{\omega}{2\pi}\int_0^{2\pi/\omega}\int_0^{A_c} uP\cos[\omega t]dAdt}; \qquad \text{Equation 3}$$
$$\equiv \frac{c_p}{\omega^2}M_\eta[Pr, \alpha]$$

where Ac($m^2$) is all section area of the flow path of the COSMOS type heat pipe; $c_p$(j/kg K) is specific heat at constant pressure; and u(m/s) is a flow rate of the charged liquid.

Equation 1 shows that the effective thermal diffusivity $\kappa_{ef}$ is proportional to $S^2$ and equation 3 shows that the reference motion coefficient $\kappa_{se}$ is not proportional to S, whereby it is suitable that the volume amplitude S of the oscillatory flow is set to a maximum value allowable in a system. Accordingly, in the present embodiment, the condition for maximizing the non-dimension effective thermal diffusivity $\kappa_{ef}$* and the motion coefficient when the volume amplitude S of the oscillatory flow is predetermined will be considered.

First, supposing the condition for maximizing the non-dimension effective thermal diffusivity.

Figure 3:
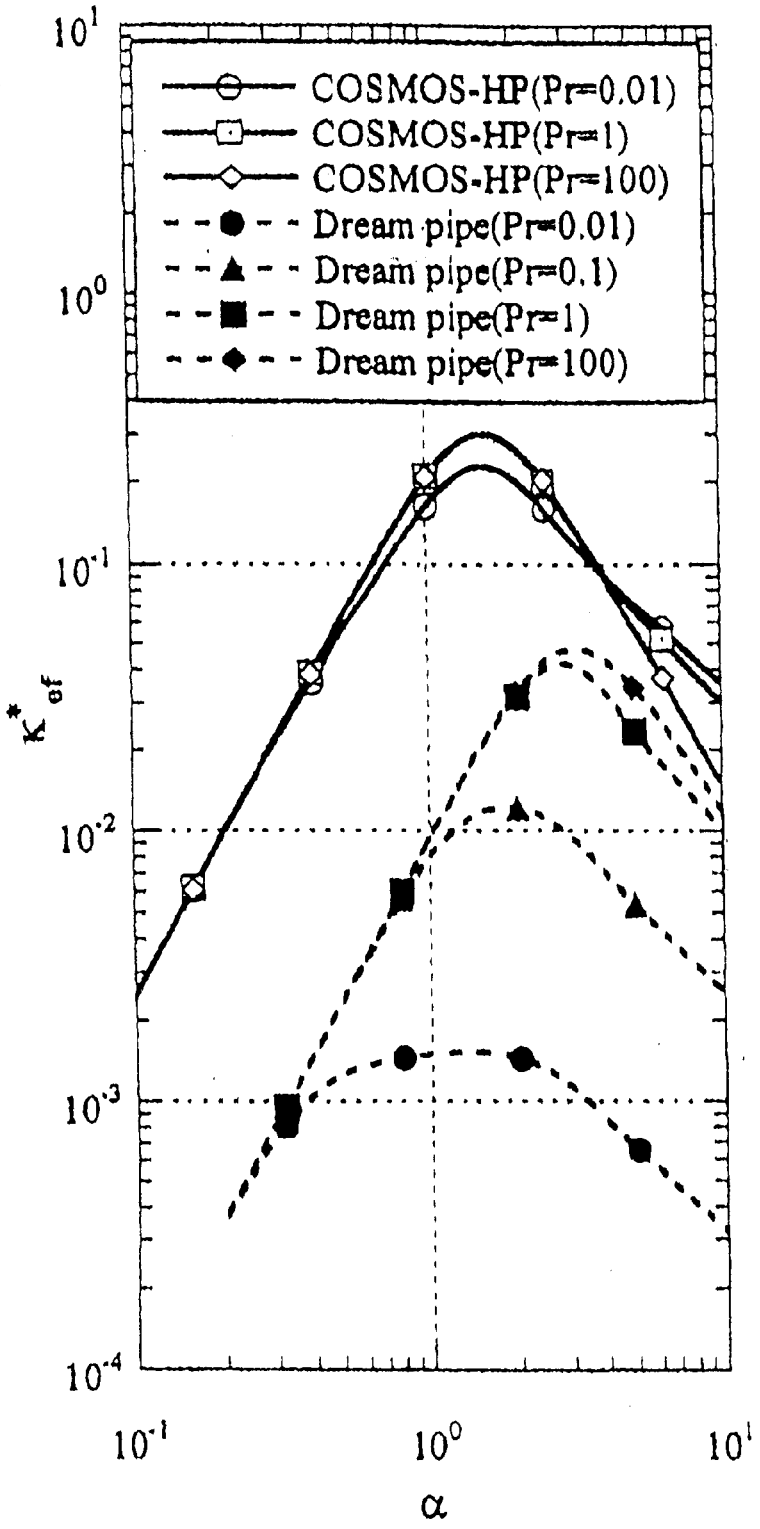
FIG. 3 is a graph showing a relation of the non-dimension effective thermal diffusivity $\kappa_{ef}$* and modified Womersley number α as a parameter of Prandtle number Pr.

FIG. 3 is a graph showing a relation of the non-dimension effective thermal diffusivity $\kappa_{ef}$* and modified Womersley number α as a parameter of Prandtle number Pr.

In the graph as shown in FIG. 3, the ordinate axis shows the dimensionless effective thermal diffusivity kef* and the abscissa axis shows the modified Womersley number α. The symbol of hollow circle shows a COSMOS type heat pipe. The symbol, ○, □, ◇ shows the Prandtle number Pr=0.01, 1, 100, respectively. The symbol of solid circle shows a dream type heat pipe. The symbol, ●, ▲, ■, ♦ shows the Prandtle number Pr=0.01, 0.1, 1, 100, respectively.

The graph in FIG. 3 shows the existence of the modified Womersley number α by which the non-dimension effective thermal diffusivity $\kappa_{ef}$* becomes the maximum for each Prandtle number Pr in the both cases of the COSMOS type heat pipe and the dream type heat pipe. The typical maximum values are described below:

(A) In the case of the COSMOS type heat pipe (A1) For the Prandtle number Pr=0.01, the dimensionless effective thermal diffusivity $\kappa_{ef}$* is 0.228 when the modified Womersley number α is 1.56;

(A2) For the Prandtle number Pr=1, the dimensionless effective thermal diffusivity $\kappa_{ef}$* is 0.299 when the modified Womersley number α is 1.56;

(A3) For the Prandtle number Pr=100, the dimensionless effective thermal diffusivity $\kappa_{ef}$* is 0.300 when the modified Womersley number α is 1.57;

(B) In the case of the dream type heat pipe (B1) For the Prandtle number Pr=0.01, the dimensionless effective thermal diffusivity $\kappa_{ef}$* is 0.00152 when the modified Womersley number α is 1.34;

(B2) For the Prandtle number Pr=0.1, the dimensionless effective thermal diffusivity $\kappa_{ef}$* is 0.0122 when the modified Womersley number α is 1.84;

(B3) For the Prandtle number Pr=1, the dimensionless effective thermal diffusivity $\kappa_{ef}$* is 0.0420 when the modified Womersley number α is 2.89;

(B4) For the Prandtle number Pr=100, the dimensionless effective thermal diffusivity $\kappa_{ef}$* is 0.0477 when the modified Womersley number α is 3.19.

In the present invention, from a viewpoint that the non-dimension effective thermal diffusivity $\kappa_{ef}$* of the COSMOS type heat pipe has a larger range in the modified Womersley number α than that of the dream type heat pipe, the modified Womersley number α is determined at 0.4 to 7.

Next, the condition for maximizing the motion coefficient will be considered.

On the desired effective thermal diffusivity of $\kappa_{ef,0}$, the following equation is obtained from equation 1.

$$\omega = \frac{\kappa_{ef,0}}{S^2 M_\kappa[Pr, \alpha]}; \qquad \text{Equation 4}$$

By substituting equation 4 for equation 3, next equation 5 is obtained.

$$\eta_{se,0} = \left(\frac{c_p S^4}{\kappa_{ef,0}^2}\right) M_\kappa[Pr, \alpha]^2 M_\eta[Pr, \alpha] \qquad \text{Equation 5}$$
$$\equiv \left(\frac{c_p S^4}{\kappa_{ef,0}^2}\right)\eta_0[Pr, \alpha];$$

Figure 4:
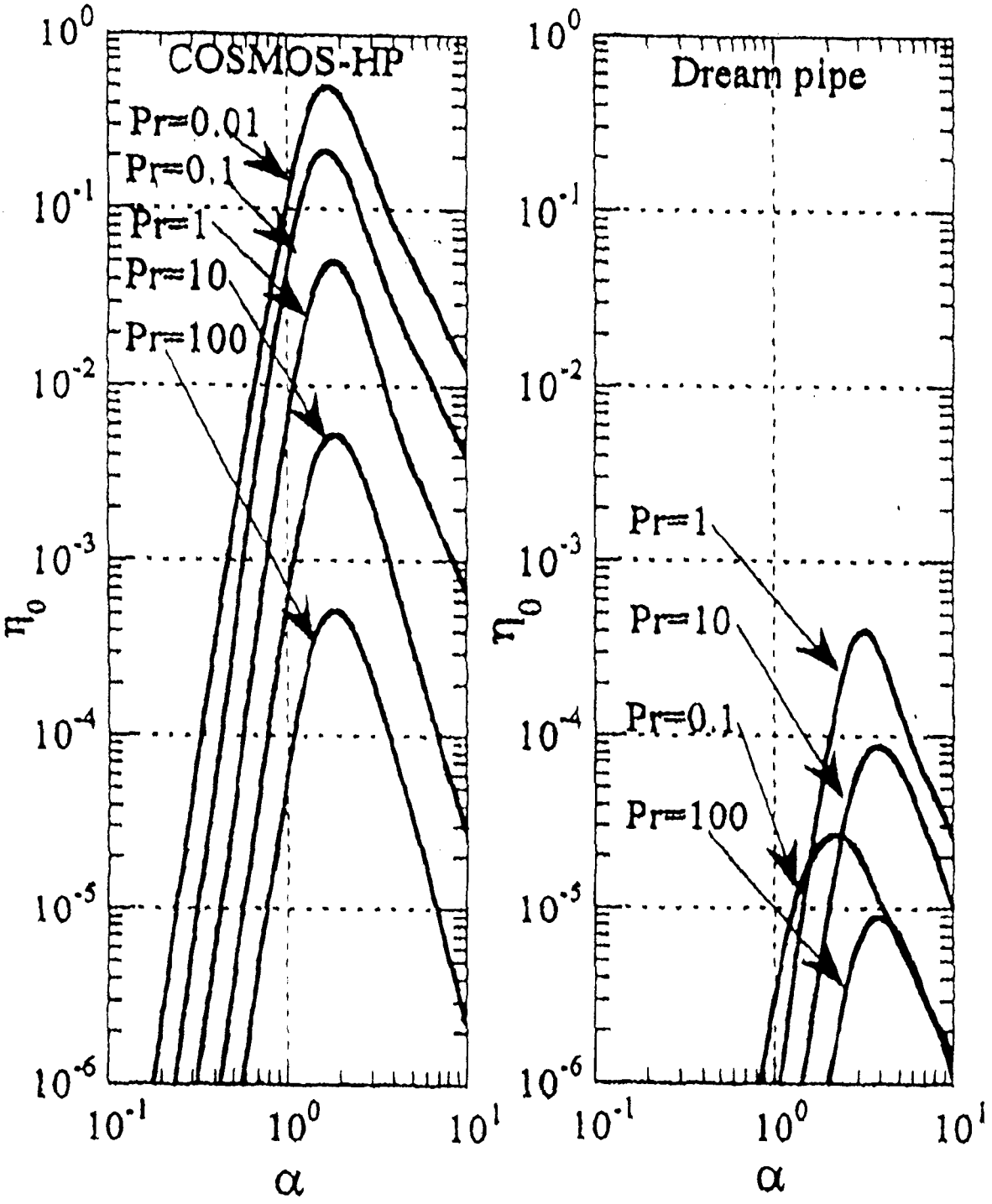
FIG. 4 is a graph showing a relation of a motion coefficient $\eta_0$ in equation 5 and the modified Womersley number α as a parameter of Prandtle number Pr.

FIG. 4 is a graph showing a relation of a motion coefficient $\eta_0$ in equation 5 and the modified Womersley number α as a parameter of Prandtle number Pr. FIG. 4(A) is a graph in the case of the COSMOS type heat pipe, and FIG. 4(B) is a graph in the case of the dream type heat pipe.

In the graph as shown in FIG. 4, the ordinate axis shows a motion coefficient in the equation 5 and the abscissa axis shows the modified Womersley number α. For the COSMOS type heat pipe in FIG. 4(A), a graph is shown in the cases of the Prandtle number Pr of 0.01, 0.1, 1, 10 and 100. For the dream type heat pipe in FIG. 4(B), a graph is shown in the cases of the Prandtle number Pr of 0.1, 1, 10 and 100.

The graph in FIG. 4 shows the existence of the modified Womersley number α by which the motion coefficient $\eta_0$ becomes the maximum for each Prandtle number Pr in the both cases of the COSMOS type heat pipe and the dream type heat pipe. Typical maximum values are described below;

(C) In the case of the COSMOS type heat pipe (as shown in FIG. 4(*a*))

(C1) For the Prandtle number Pr=00.1, the motion coefficient $\eta_0$ is 0.503 when the modified Womersley number α is 1.72;

(C2) For the Prandtle number Pr=0.1, the motion coefficient $\eta_0$ is 0.213 when the modified Womersley number α is 1.69;

(C3) For the Prandtle number Pr=1, the motion coefficient $\eta_0$ is 0.0502 when the modified Womersley number α is 1.84;

(C4) For the Prandtle number Pr=10, the motion coefficient $\eta_0$ is 0.00525 when the modified Womersley number α is 1.87;

(C5) For the Prandtle number Pr=100, the motion coefficient $\eta_0$ is 0.000525 when the modified Womersley number α is 1.87;

(D) In the case of the dream type heat pipe (as shown in FIG. 4(*b*))

(D1) For the Prandtle number Pr=0.1, the motion coefficient $\eta_0$ is $2.67\times10^{-5}$ when the modified Womersley number $\alpha$ is 2.25;

(D2) For the Prandtle number Pr=1, the motion coefficient $\eta_0$ is $4.02\times10^{-4}$ when the modified Womersley number $\alpha$ is 3.21;

(D3) For the Prandtle number Pr=10, the motion coefficient $\eta_0$ is $8.73\times10^{-5}$ when the modified Womersley number $\alpha$ is 3.84;

(D4) For the Prandtle number Pr=100, the motion coefficient $\eta_0$ is $8.86\times10^{-6}$ when the modified Womersley number $\alpha$ is 3.85.

The maximized motion coefficient $\eta_0$ is achieved when the charged liquid has nearly specific heat $c_p$ at constant pressure and the desired effective thermal diffusivity $\kappa_{ef,0}$ is obtained under the condition having a constant volume amplitude S of the oscillatory flow, as shown in equation 5. Accordingly, determination of the condition for maximizing the motion coefficient $\eta_0$ enables the motion coefficient to be maintained within the appropriate range. Therefore, when the volume amplitude S of the oscillatory flow is obtained, the condition for optimizing the motion coefficient $\eta_0$ and the thermal diffusivity (dimensionless effective thermal diffusivity $\kappa_{ef}$) can be defined. In the determined range of $\alpha$=0.4 to 7, the motion coefficient $\eta_0$ of the COSMOS type heat pipe is higher than that of the dream type heat pipe, whereby it is within the appropriate range.

Next, the typical value referring to the COSMOS type heat pipe based on the above-mentioned condition will be described.

The average temperature of the charged liquid in the forced oscillatory flow type heat pipe supposes 300K and the charged liquid supposes Na—K (Prandtle number Pr=0.045), water (Prandtle number Pr=5.85) or ethanol (Prandtle number Pr=20.8). And, the volume amplitude S of the oscillatory flow supposes 50 mm and the angle frequency $\omega$ thereof supposes 2 $\pi$ (the frequency is 1 Hz).

FIG. 5 is a table showing a relation of a width 2H of the flow path, the ratio x of the obtained effective thermal diffusivity to the thermal diffusivity of copper and the value of the reference motion coefficient $\eta_{se}$. Here, the reference motion coefficient $\eta_{se}$ is obtained in the case of the temperature gradient $\Omega$=1K/m.

As shown in the table in FIG. 5, the COSMOS type heat pipe under the above-mentioned optimum condition (that is the condition for maximizing $\eta_0$) has the ratio of the effective thermal diffusivity to the thermal diffusivity of copper of 34 to 40, even if the charged liquid is Na—K, water or ethanol, so that it would have higher effective thermal diffusivity and motion coefficient than those of copper. For example, when the actual temperature gradient is 10 K/m and the charged liquid is water, the COSMOS type heat pipe designed based on the condition according to the present invention will result in having a heat transport capacity thereof about 40 times of that of copper. Here, the driving work energy for the oscillatory flow is 1/89 of the heat transport capacity from $\eta_{se}$ and 10 k/m as shown in FIG. 5. So, the heat transfer of forty times more heat transfer of copper can be achieved with a driving work energy about 1% of the heat transport capacity.

EFFECT OF THE INVENTION

The present invention, as described above, provides a forced oscillatory flow type heat pipe having the ratio of the heat transport capacity to the oscillating energy within an appropriate range.

What is claimed is:

1. A forced oscillatory flow type heat pipe having a heat pipe body with a closed loop flow path which meanders between a heat absorbing section and a heat radiating section, a liquid charged in said flow path and a mechanism causing an oscillatory flow of said charged liquid, wherein phases of said oscillatory flows of said charged liquid in the adjacent passages of said meandering flow path being inverted, wherein said charged liquid has a Prandtl number Pr of less than 100 and a modified Womersley number $\alpha$ of 0.4 to 7, the modified Womersly number being defined as $$\alpha=H(\omega/K)^{1/2}$$

where H(m) is half of a width of said flow path; $\omega$ (1/s) is the angle frequency of oscillation; and $\kappa(m^2/s)$ is the heat diffusion coefficient of the charged liquid.

2. The forced oscillatory flow type heat pipe according to claim 1, wherein said Prandtle number Pr is less than 50 and said modified Womersely number $\alpha$ is 0.4 to 7.

3. The forced oscillatory flow type heat pipe according to claim 1, wherein the specific heat $C_p$ of said charged liquid is higher than 100 j/kg.K.

4. A forced oscillatory flow type heat pipe having a heat pipe body with a closed loop flow path which meanders between a heat absorbing section and a heat radiating section, a liquid charged in said flow path and a mechanism causing an oscillatory flow of said charged liquid, wherein:

phases of said oscillatory flows of said charged liquid in the adjacent passages of said meandering flow path is inverted;

said charged liquid has a Prandtl number Pr of less than 100; and a modified Womersly number $\alpha$ is given within a certain range, where a motion coefficient $\eta_0$, derived from the following equation, takes an approximately maximum value, the motion coefficient $\eta_0$ being defined as $$\eta_0[Pr;\ \alpha]=M_K[PR,\ \alpha]^2M_{72}\ [\mathrm{Pr},\ \alpha].$$

5. A method for designing a forced oscillatory flow type heat pipe having a heat pipe body with a closed loop flow path which meanders between a heat absorbing section and a heat radiating section, a liquid charged in said flow path and a mechanism causing an oscillatory flow of said charged liquid, wherein phases of said oscillatory flows of said charged liquid in the adjacent passages of said meandering flow path being inverted, wherein said charged liquid has a Prandtl number Pr of less than 100 and a modified Womersley number $\alpha$ of 0.4 to 7, the modified Womersly number being defined as $$\alpha=H(\omega/K)^{1/2},$$

where H(m) is half of a width of said flow path; $\omega$ (1/s) is angle frequency of oscillation; and is $\epsilon(m^2/s)$ is heat diffusion coefficient of the charged liquid.

6. The forced oscillatory flow type heat pipe according to claim 2, wherein the specific heat $C_p$ of said charged liquid is higher than 100 j/kg.K.

* * * * *